US005230600A

United States Patent [19]

Marino

[11] Patent Number: 5,230,600

[45] Date of Patent: Jul. 27, 1993

[54] ATTACHMENT FOR LIFT TRUCKS

[76] Inventor: Salvatore Marino, 28 Clearview Rd., East Brunswick, N.J. 08816

[21] Appl. No.: 806,614

[22] Filed: Dec. 12, 1991

[51] Int. Cl.[5] ..... B66F 9/18

[52] U.S. Cl. ..... 414/607; 414/664; 414/785

[58] Field of Search ..... 414/607, 608, 785, 641, 414/664, 668, 666, 670; 187/9 E

[56] References Cited

U.S. PATENT DOCUMENTS

| | | | |
|---|---|---|---|
| 2,610,751 | 9/1952 | Bevan | 414/608 |
| 2,698,698 | 1/1955 | Smith et al. | 414/785 X |
| 2,726,781 | 12/1955 | Stanley | 414/607 |
| 2,744,645 | 5/1956 | Cirillo | 414/607 |
| 2,975,924 | 3/1961 | Kopanski | 414/785 |
| 3,023,919 | 3/1962 | Hobson | 414/785 X |
| 3,200,978 | 8/1965 | Brady et al. | 414/607 X |
| 3,223,259 | 12/1965 | Nicholson | 414/607 X |
| 3,477,600 | 11/1969 | Sawyer | 414/607 X |
| 3,930,563 | 1/1976 | Abels | 187/9 E |
| 4,024,972 | 5/1977 | Hobson | 414/607 |
| 4,467,893 | 8/1984 | Hobson | 414/607 X |
| 4,560,317 | 12/1985 | Kellett | 414/785 X |
| 5,026,245 | 6/1991 | Sabo | 414/785 X |

FOREIGN PATENT DOCUMENTS

| | | | |
|---|---|---|---|
| 548073 | 11/1956 | Belgium | 414/608 |
| 3542619 | 6/1987 | Fed. Rep. of Germany | 414/785 |

*Primary Examiner*—David A. Bucci
*Attorney, Agent, or Firm*—Horst M. Kasper

[57] ABSTRACT

A lift truck attachment for handling loads comprises a main frame assembly for attachment to an elevator of a lift truck and a lower slide assembly. A first channel member is associated with a first main frame vertical tube and disposed in an upright position. A second channel member is associated with a second main frame vertical tube and disposed substantially parallel to the first channel member. Upper closing members with center bores are attached to upper ends of the main frame vertical tubes and of lower sliding tubes. Lower sliding tubes are slidingly disposed in the main frame vertical tubes. First and second end members are attached at upper ends of first and second bolts. Third and fourth end members are attached at lower ends of first and second bolts. The first and second bolts pass through the center bores. The closing members are disposed between the first and third end members and between the second and fourth end members, respectively.

14 Claims, 10 Drawing Sheets 16
191
115
56
17
22
F
F
16
56
17
75
118
19
24
115
24
22
22
E
E
16
191
19
157
79
78
115
39
65
34
G
57
70
58
G
57
70
100
18
34
58
19

ATTACHMENT FOR LIFT TRUCKS

BACKGROUND OF THE INVENTION

1. Field of the Invention

This invention relates to an attachment for lift trucks.

2. Brief Description of the Background of the Invention Including Prior Art

L. L. Hobson in the U.S. Pat. No. 3,023,919 teaches lift truck attachment. A frame is provided which can be attached to an elevator mechanism of a lift truck. An abutment element is mounted upon said frame in such a manner that the frame and the abutment element are vertically movable relative to each another. An element is provided which projects from said frame for engaging an object to be lifted.

L. L. Hobson teaches to employ open vertical channels for providing support for an upward and downward motion of the attachment. Sliding members slide on the vertical channels. The open channels have been found to be susceptible to being easily dented and to be impeding a slipping motion. It has further been found that these channels are especially vulnerable because the slender edges are right in front of the attachment. Moreover, the slender edges are protruding beyond any other member of the attachment structure. Hence the position of the channels is particularly prone to interference and damages.

SUMMARY OF THE INVENTION

1. Purposes of the Invention

It is a general object of this invention to provide a dual purpose attachment—first, for the general use of forks and, second, a means for top-handling cartons of major household appliances. All this can be achieved through the use of one single attachment on one lift truck instead of singular purpose attachments on two lift trucks.

It is an object of the invention to provide for disengageable extension plates attached to the attachment element of a lift truck to avoid collisions with other lift trucks.

It is a further object of the present invention to provide an improved attachment for a lift truck.

It is yet another object of the present invention to provide an attachment for a lift truck which can be easily manufactured at economic cost.

It is yet a further object of the present invention to provide an attachment structure for a lift truck, which is reliable and minimizes possibilities of breakage during frequently rough operations of such lift truck.

These and other objects and advantages of the present invention will become evident from the description which follows.

2. Brief Description of the Invention

According to the present invention there is provided for a lift truck attachment for handling loads. A main frame assembly for attachment to an elevator of a lift truck includes the following elements. A first channel member is disposed in an upright position. A second channel member is disposed substantially parallel to the first channel member. A first main frame vertical tube is associated with the first channel member. A second main frame vertical tube is associated with the second channel member. A first upper closing member with a first center bore is attached to an upper end of the first main frame vertical tube. A second upper closing member with a second center bore is attached to an upper end of the second main frame vertical tube. A lower slide assembly includes the following elements. A first lower sliding tube is slidingly disposed in the first main frame vertical tube. A second lower sliding tube is slidingly disposed in the second main frame vertical tube. A third upper closing member with a third center bore is attached to an upper end of the first lower sliding tube. A fourth upper closing member with a fourth center bore is attached to an upper end of the second lower sliding tube. A first bolt has attached a first end member at an upper end and has attached a third end member at a lower end and passes through the first center bore and passes through the third center bore such that the first closing member and the third closing member are disposed between the first end member and the third end member. A second bolt has attached a fourth end member at an upper end and has attached a second end member at a lower end and passes through the second center bore and passes through the fourth center bore such that the second closing member and the fourth closing member are disposed between the second end member and the fourth end member.

A first flange plate can exhibit upwardly extending holes with a larger size in an upper region of the bore hole. A first bar can have pins with pin heads disposed on a first side of the first bar and matching the holes of the first flange plate. First hinged parts can extend horizontally on a second side of the first bar disposed opposite to the first side of the first bar. A first breakaway wing can be attached to the first hinged parts. A second flange plate can have upwardly extending holes with a larger size in an upper region of the bore hole. A second bar can have pins with pin heads disposed on a first side of the first bar and matching the holes of the second flange plate. Second hinged parts can extend horizontally on a second side of the second bar disposed opposite to the first side of the second bar. A second breakaway wing can be attached to the second hinged parts.

A first horizontally disposed pin can be attached to one of the first hinged parts. A first projection arm of the first breakaway wing having a horizontal groove can engage the first horizontal pin from above for forming a disengageable connection between the first bar and the first breakaway wing. A second horizontally disposed pin can be attached to one of the second hinged parts. A second projection arm of the second breakaway wing having a horizontal groove can engage the second horizontal pin from above for forming a disengageable connection between the second bar and the second breakaway wing.

A first upright pin can be attached to the first main frame vertical tube. A first V-shaped block can have a first upright borehole with a larger upper diameter. The first upright pin can be disposed in the first upright bore hole allowing the block to shift in a plane parallel to a plane spanned by the first main frame vertical tube and the second main frame vertical tube. A first lifting blade can be attached to the first upright block. A second upright pin can be attached to the second main frame vertical tube. A second V-shaped block can have a second upright borehole with a larger upper diameter. The second upright pin can be disposed in the second upright bore hole allowing the block to shift in a plane parallel to a plane spanned by the first main frame vertical tube and the second main frame vertical tube. A second lifting blade can be attached to the second upright block.

A first fork can be attached to a first side plate set of the main frame assembly. A first pin hole can be disposed substantially horizontally in the first fork. A first fork locking pin can be hingedly supported. A first weight can be attached to the first fork locking pin for retaining the first fork locking pin in a locked position while engaging the first fork. A second fork can be attached to a second side plate set of the main frame assembly. A second pin hole can be disposed substantially horizontally in the second fork. A second fork locking pin can be hingedly supported. A second weight can be attached to the second fork locking pin for retaining the second fork locking pin in a locked position while engaging the second fork.

A first fork can be attached to a first side plate set of the main frame assembly. A first stop face can be furnished at a first heel of the first fork. First adjustment means can engage the first stop face for adjusting a position of the first fork when lowered. A second fork can be attached to a second side plate set of the main frame assembly. A second stop face can be furnished at a second heel of the second fork. Second adjustment means can engage the second stop face for adjusting a position of the second fork when lowered.

A first plastic guide can be attached to the upper end of the first lower sliding tube for defining a lateral position of the first lower sliding tube in the first main frame vertical tube. A second plastic guide can be attached to the upper end of the second lower sliding tube for defining a lateral position of the second lower sliding tube in the second main frame vertical tube.

A first cushion can be disposed between the first closing member and the first end member. A second cushion can be disposed between the second closing member and the second end member.

A third cushion can be disposed between the third closing member and the first end member. A fourth cushion can be disposed between the fourth closing member and the second end member.

A first tube locking pin can lock the first main frame vertical tube to the first sliding tube. A second tube locking pin can lock the second main frame vertical tube to the second sliding tube for immobilizing the lower slide assembly relative to the main frame.

A first fork can be attached to a first side plate set of the main frame assembly. A second fork can be attached to a second side plate set of the main frame assembly. A first fork plate can be disposed upright neighboring the first fork on a side remote relative to the second fork and set back by at least 0.5 centimeters relative to an upright rest position of the first fork and of the second fork.

A first fork can be attached to a first side plate set of the main frame assembly. A second fork can be attached to a second side plate set of the main frame assembly. A second fork plate can be disposed upright neighboring the second fork on a side remote relative to the first fork and set back by at least 0.5 centimeters relative to an upright rest position of the first fork and of the second fork.

A first fork can be attached to a first side plate set of the main frame assembly. A second fork can be attached to a second side plate set of the main frame assembly. A third fork plate can be disposed upright between the first fork and the second fork and set back by at least 0.5 centimeters relative to an upright rest position of the first fork and of the second fork.

A fourth fork plate can be disposed upright between the first fork and the second fork and set back by at least 0.5 centimeters relative to an upright rest position of the first fork and of the second fork.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figures 1, 1A, 1B:
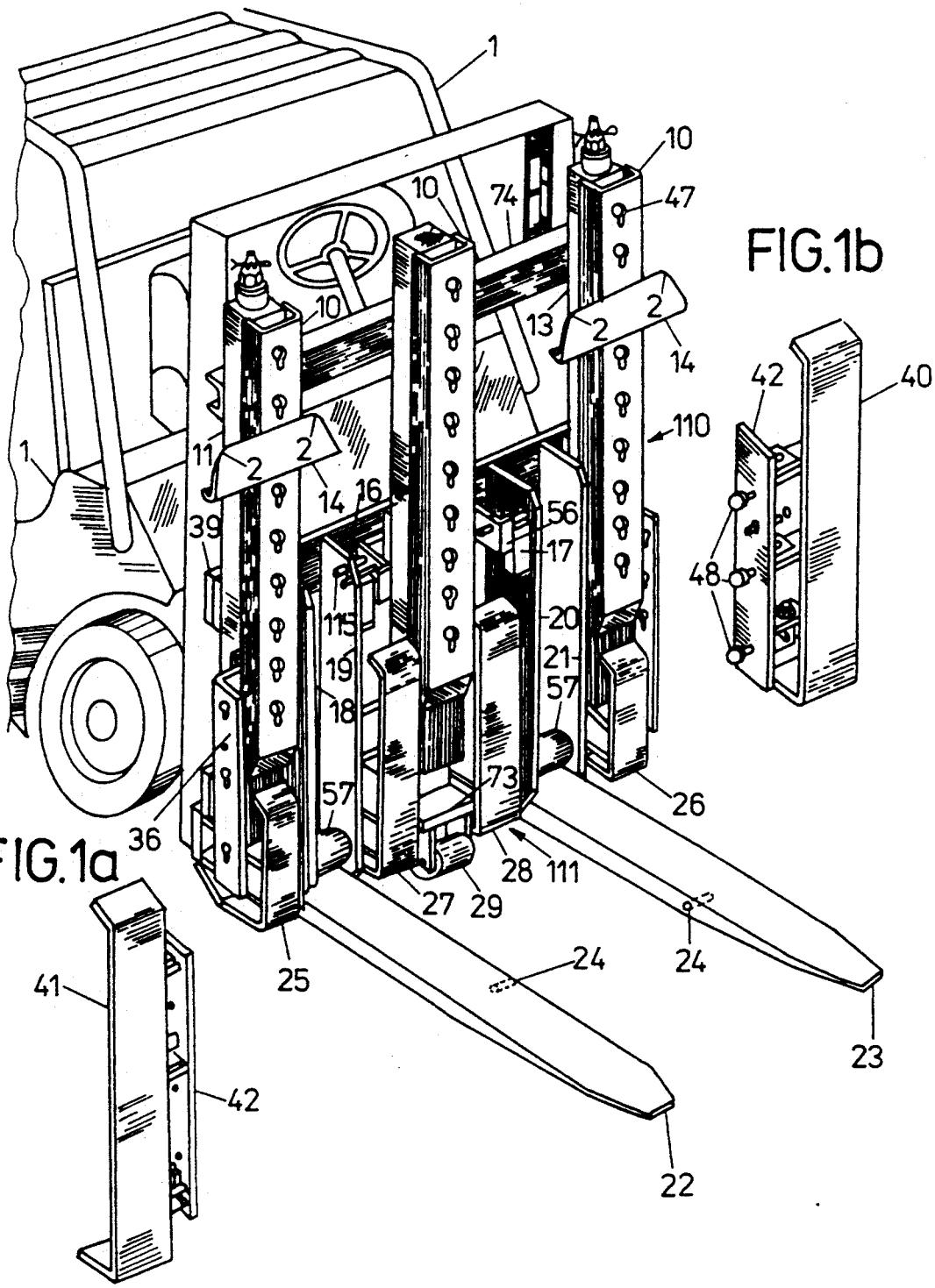
FIG. 1 is a perspective, partial elevational view of a lift truck with the invention attachment, including the main frame assembly and the lower slide assembly, in a mounted position.
FIG. 1*a* is a perspective view of a first side attachment of the left side of the attachment of the lift truck of FIG. 1.
FIG. 1*b* is a perspective view of a second side attachment on the right side of the attachment of the lift truck of FIG. 1.

FIG. 1 illustrates a lift truck 1 comprised of two main assemblies, i.e. a main frame assembly 110, and a lower slide assembly 111. The lower slide assembly 111 operates vertically and reciprocally with the main frame assembly 110. The main frame assembly 110 comprises two folding forks 22 and 23. The folding forks 22 and 23 are supported by respective side plates 18, 19, 20, 21. Keyhole holes 67, 68, 69 (FIG. 3) are provided for the positioning of the side attachments 40, 41 (FIGS. 1*a*, 1*b*). Said side attachments 40, 41 are furnished with pins 48. The pins 48 are placed in the keyholes 67, 68. 69.

Figure 2:
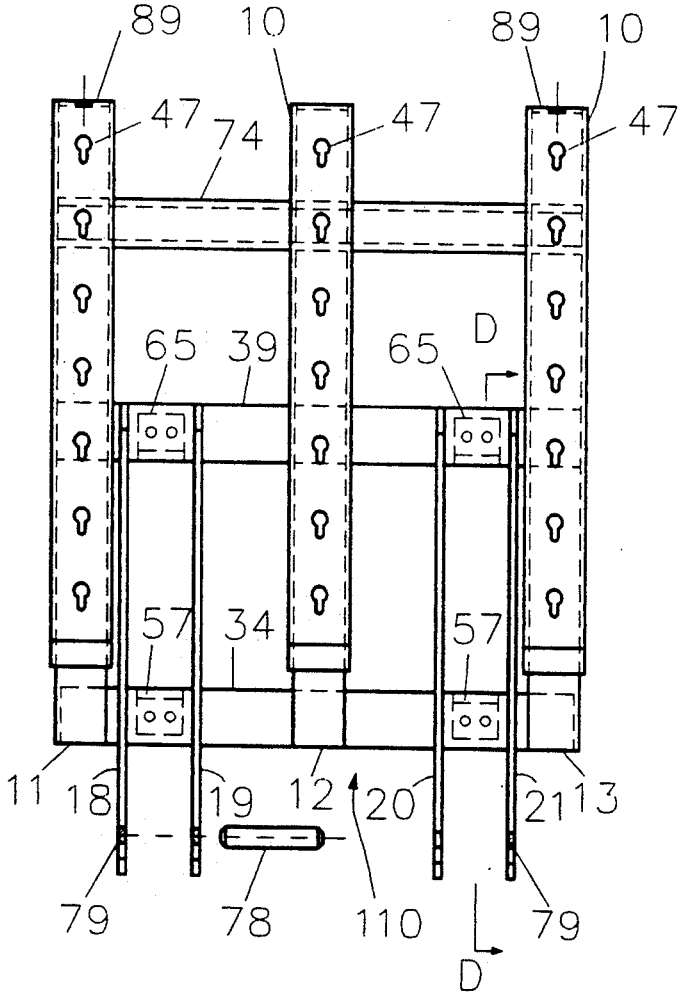
FIG. 2 is a front view of the main frame assembly of the attachment of FIG. 1.
Figure 2A:
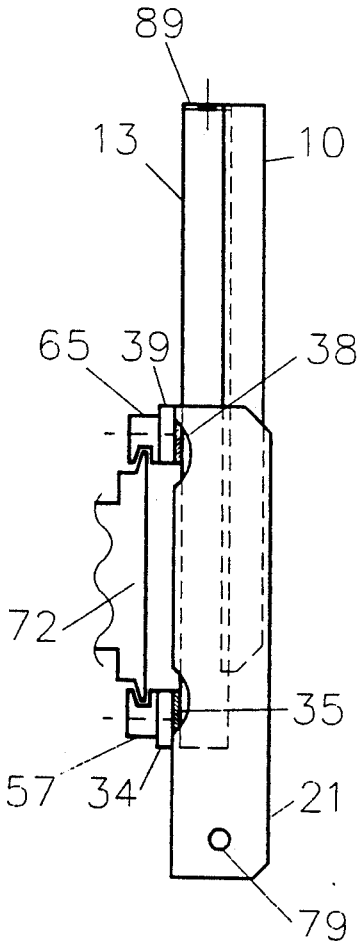
FIG. 2*a* is a partial sectional side view of the main frame assembly along section line D—D of FIG. 2.

As illustrated in FIG. 2, the main frame assembly 110 is comprised of three vertical tubes 11, 12, 13. Three vertical channels 10 with keyholes 47 are fixed to said vertical tubes 11, 12, 13. The assemblies, formed in each case by the vertical channels 10 and the vertical tubes 11, 12, 13, are tied together by horizontal members 34, 39, 74. The four side plates 18, 19, 20, 21 act as side supports for the folding forks 22 and 23. As illustrated in FIG. 2, a horizontal pin 78 serves as a shaft. The folding fork 22 rotates around said horizontal pin 78. Grip blocks 65 and 57 serve for mounting the main frame assembly 110 to an elevator portion 72 (FIGS. 2, 6) of the lift truck 1.

Figure 3A:
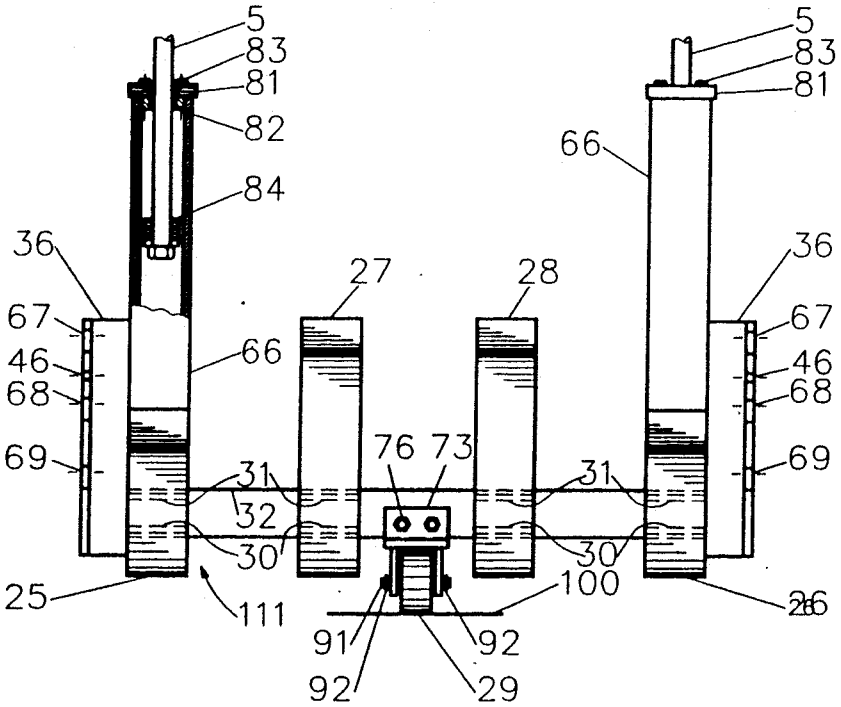
FIG. 3*a* is a side view of the lower slide assembly of FIG. 3.
Figure 3:
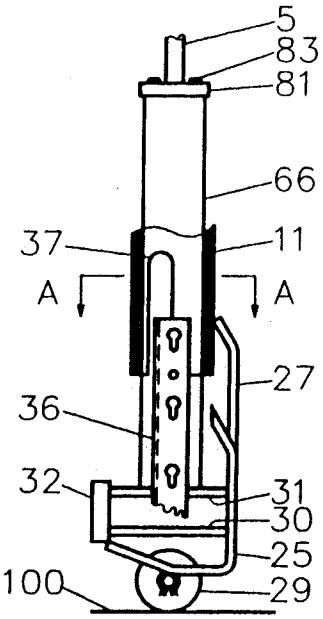
FIG. 3 is a front view of the lower slide assembly with an attachment means to the main frame of FIG. 1.
Figure 3B:
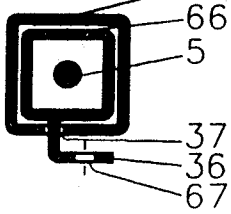
FIG. 3*b* is a cross-sectional view through the main frame and lower slide assemblies along section lines A—A of FIG. 3*a;*

As illustrated in FIG. 3, the lower slide assembly 111 is essentially comprised of two sliding tubes 66. These two sliding tubes 66 are slid into the vertical tubes 11 and 13 of the main frame assembly 110, as illustrated in FIG. 3*a*. A lower slide member 32 and tie bars 31 hold together the two sliding tubes 66. Pierced angles 36 are attached to the sliding tubes 66 for receiving the breakaway wings or side attachments 40 and 41. Additional tie bars 30 join with the tie bars 31 to form a support for pusher plates 25, 26, 27, and 28. The pusher plates 25, 26, 27, 28 are all disposed in one plane (plane A). As illustrated in FIG. 3, the wheel assembly is comprised of a roller 29, a roller bracket 73, a roller shaft 91, and retaining lock rings 92. The wheel assembly is attached to the horizontal lower slide bar 32 by means of fasteners 76. The sliding tubes 66 comprise in each case in their upper portion a long bolt 5 with a cushioned end 84 and a wear guide 81.

A slot 37 in the main frame tube 11 allows for an upward movement of the pierced angles 36, wherein said angles 36 are attached to the lower slide assembly 111.

Figure 4:
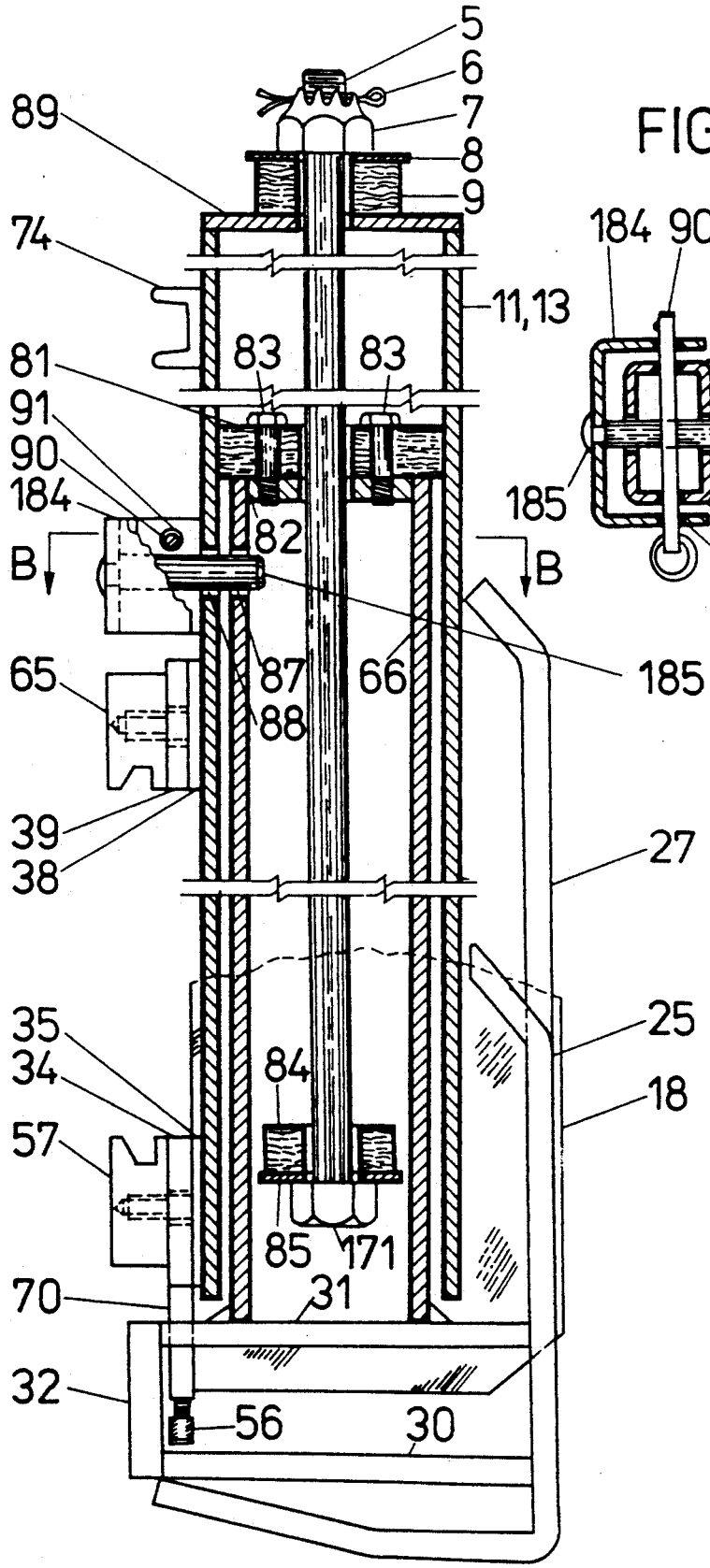
FIG. 4 is a sectional view of the reciprocal arrangement between the lower slide assembly and the main frame assembly.
Figure 4A:
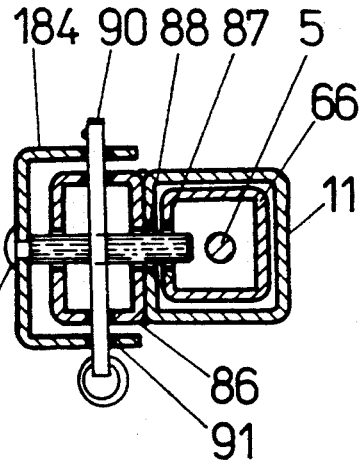
FIG. 4*a* is a cross-sectional view through the tubes of the main frame assembly along the section line B—B of FIG. 4.

The complete tubing arrangement between the main frame assembly 110 and the lower slide assembly 111 is shown in FIGS. 4 and 4*a*. The lower slide assembly 111 is attached to the main frame assembly 110. The sliding tubes 66 are capable of moving up and down with the lower slide assembly 111 versus the main frame assembly 110 comprising the main frame tubes 11, 13. However, the motion distance is limited relative to the frame in that the frame will lift the lower slide in case the upper frame has reached its motion limit. The lower slide serves for maintaining the position of the elements to be carried.

A downward travel of the sliding tubes 66 within the main frame tubes 11, 13 is in each case limited by a long bolt 5. The bolt 5 is disposed in the main frame tubes 11, 13 and the sliding tubes 66, respectively, and is held by a castle nut 7 and a cotter pin 6. A flat washer 8 is emploued to abut the castle nut 7. A cushion layer 9 of a highly elastic material can be placed between the washer 8 and a plate 89 at the head of the main frame tubes 11, 13, respectively. A second cushion layer 84, abutting on a second flat washer 85, is disposed at the head end 171 of the bolt 5. The cushion layers 9 and 84 can be made of a highly elastic polyurethane. These layers 9 and 84 provide much needed cushioning at the fully extended limit of reciprocal travel between the sliding tubes 66 of the lower slide assembly 111 and the main frame tubes 11, 13 of the main frame assembly 110. If the cushion layers 9 and 84 were not used, a continuous hammering would occur between the bolt 5 and the top plates 82 and 89. This constant hammering would result in an increased noise and in a danger of cracking.

A tight-fitting wear or slide guide 81 is disposed on the top piece 82 of the sliding tube 66. The slide guide 81 can be made of an ultra-high molecular weight polyethylene, such as Tyvar. The ultra-high molecular weight polyethylene has an extremely low coefficient of friction together with high impact strength and allows a relative sliding between the sliding tubes 66 of the lower slide assembly 111 and the main frame tubes 11, 13 of the main frame assembly 110. Said slide guide 81 is affixed to the top piece 82 by fasteners or bolts 83. Moreover, the slide guide 81 serves to lubricate the slide action and prevents sticking and wear between the sliding tubes 66 and the main frame tubes 11, 13. The castle nut 7 provides for micrometer adjustment to maintain parallelism between the main frame assembly 110 and the lower sliding assembly 111.

FIGS. 4 and 4*a* also illustrate a sectional view of the sliding tubes 66 and the main frame tubes 11, 13. Holes 88 and 87 of the main frame tubes 11, 13, and of the sliding tubes 66, respectively, receive in each case a pin 185. The pin 185 is assembled with and holds a channel 184. When the pins 185 are inserted into said holes 88 and 87, said pins 185 maintain the sliding tubes 66 fixedly in their uppermost position in the main frame tubes 11, 13. A locking pin 90 prevents the assembly, formed by the channel 184 and the pin 185, to retract by accident.

During the course of a sliding of the sliding tubes 66 relative to the main frame tubes 11, 13, the slide guide 81 guides and centers said sliding tubes 66 in the tubes 11 and 13, respectively. The low coefficient of friction of the ultra-high molecular weight polyethylene of the slide guide 81 together with high impact strength markedly reduces the wear between the sliding tubes 66 and the main frame tubes 11, 13.

Figure 5B:
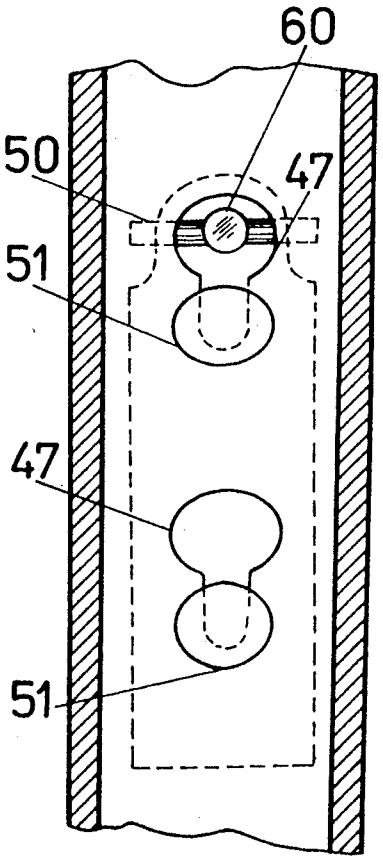
FIG. 5*b* is a partial cross-sectional view of the embodiment of FIG. 5 along line H—H.
Figure 5:
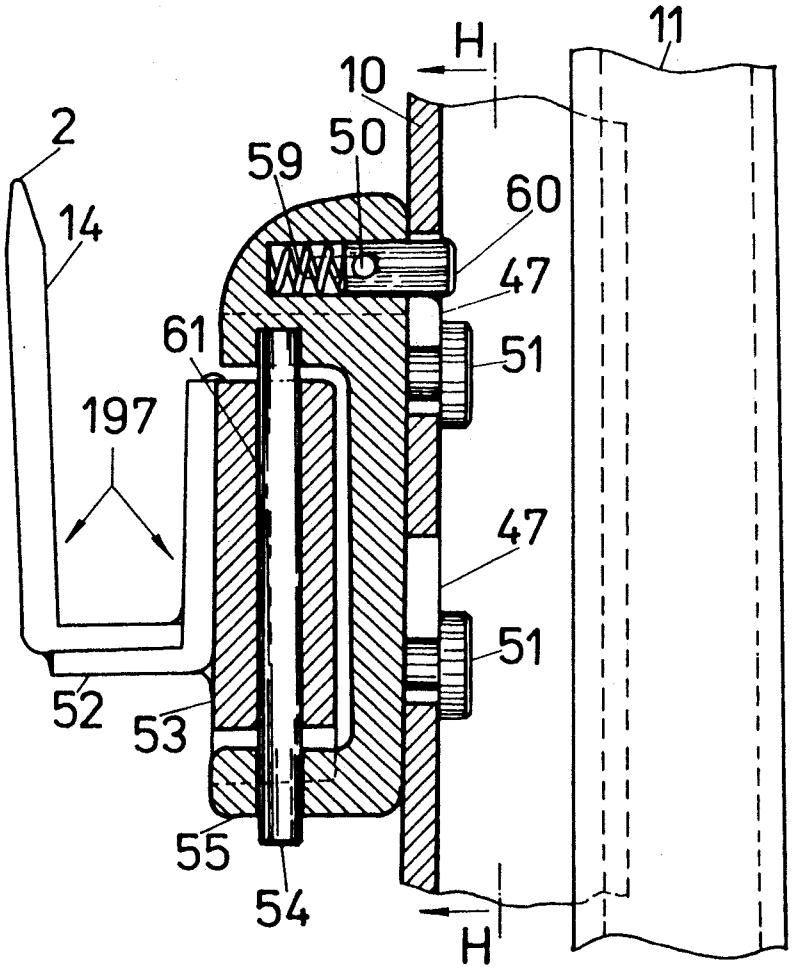
FIG. 5 is a sectional view of the attachment structure for the lifting blade assembly.

FIG. 5 illustrates a separate lifting blade assembly which can in each case be placed in different positions on the main frame tubes 11, 13. The lifting blade assembly includes a lifting blade 14 welded to a bracket piece or back angle 52. The back angle 52 is welded to a V-shaped block 53, which V-shaped block 53 includes a bore in its center. A space 197 is provided between the lifting blade 14 and the back angle 52 for engaging, for example, a top rim of a carton. The bore is substantially cylindrical at the bottom and exhibits an elongated section at the top. The elongated section is preferably provided by two semi-circles connected tangentially with straight lines. A pin 54 is housed in a bracket 55. The V-shaped block 53 is retained in the bracket 55 with the pin 54. The V-shaped block 53 with the back angle 52 and the lifting blade 14 can swivel or tilt to a small extent vertically around the pin 54. The shape of the V-shaped block 53 allows it to move around the pin 54 with a defined lower position and with two tilted upper positions. The movement of the block 53 assured that the lifting blade 14 will not exert an excessive force onto the rim of a carton but instead, if contact force occurs at one end of the lifting blade 14, then the resulting motion will be a vertical plane tilting of the V-shaped block 53 relative to an axis going through the lower center of the pin 54. The bracket 55 exhibits appurtenances 51 which can be placed into key holes 47 provided in the channels 10. The channels are attached to the main frame tubes 11, 12, 13. The spaces between the appurtenances 51 on the bracket 55 are equal to the spaces between the keyholes 47 on the channel 10 such that a respective appurtenance 51 can engage into a respective keyhole 47. The bracket 55 is maintained locked in position by a pin 60. Said pin 60 includes a cross pin 50 and a spring 59. The pin 60 rests against the top of the respective keyhole 47, wherein the pin 60 is spring-biased by the spring 59. The pin 60 is withdrawn from the keyhole 47 by pulling the cross pin 50 to compress the spring 59 which enables in this way the removal of the bracket 55 from the channels 10.

Figure 5A:
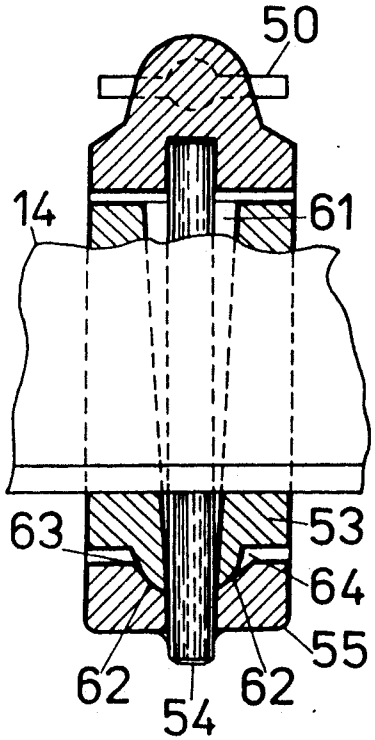
FIG. 5*a* is a sectional front view of the embodiment of FIG. 5.

While a clearance 61 for the pin 54 in the V-shaped block 53 is illustrated as being parallel to the pin 54 in FIG. 5, FIG. 5*a* shows that the clearance 61 for the pin 54 is slightly tapered toward the top of the V-shaped block 53. This tapered structure allows a tilting of the lifting assembly, formed by the lifting blade 14, the back angle 52, and the V-shaped block 53. Thus, the tilting is limited by the degree of taper provided in the V-shaped block 53. The V-shaped block 53 exhibits a curved bottom 63, where the curved bottom 63 contacts tangent points 62 of a V-shaped groove 64 of the bracket 55. In addition, gravity forces the curved bottom 63 of the V-shaped block 53 to rest in the V-shaped groove 64 of the bracket 55 and thereby provides a restraint to rotation of the lifting assembly about the pin 54 in the V-shaped block 53. This restraint is proportional to the weight of the lifting blade 14, i.e. the weight carried by the lifting blade 14.

Figure 6:
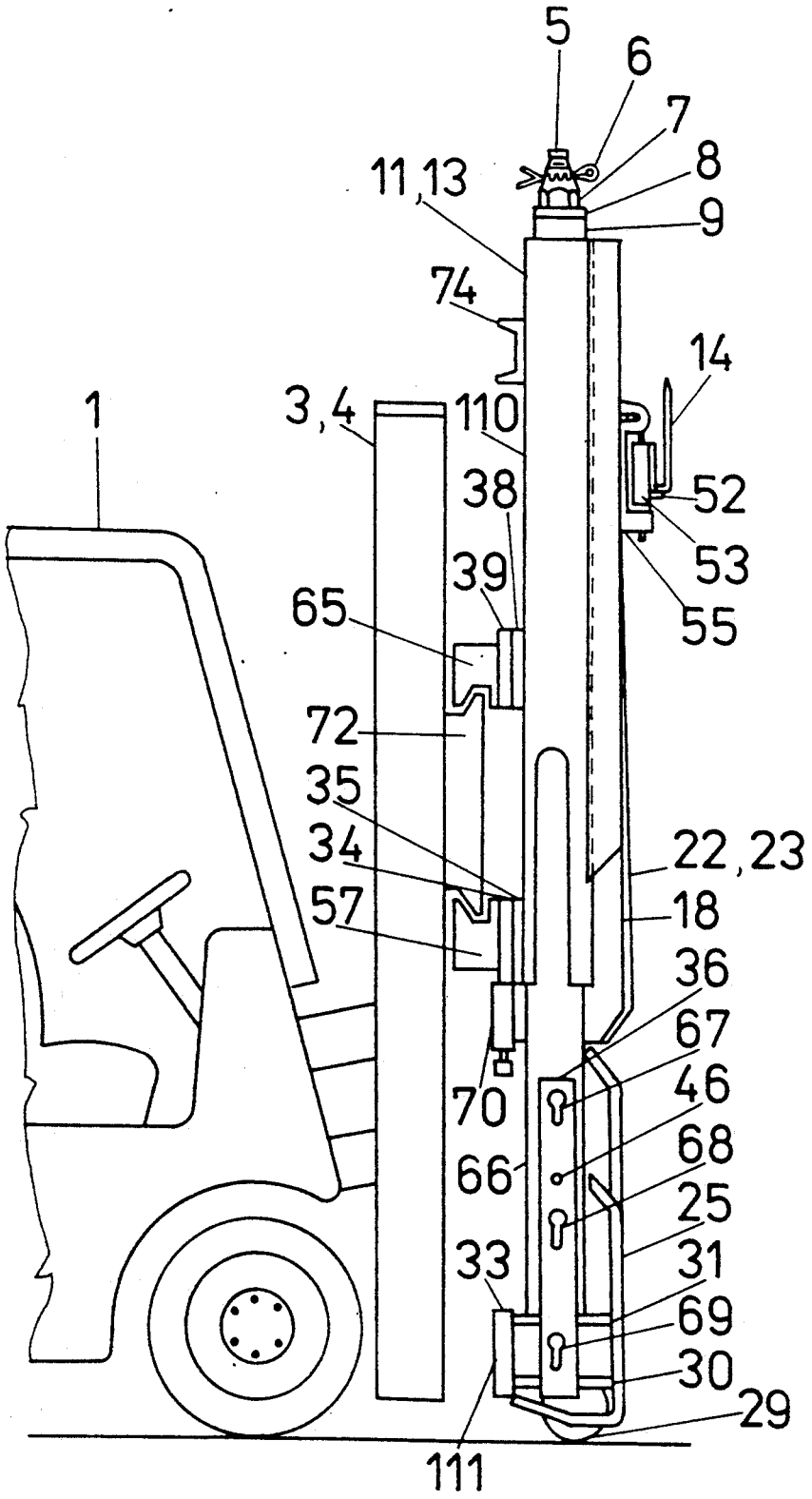
FIG. 6 is a side view of the lift truck with the main frame assembly and the lower slide assembly and with the folding fork in an upright folded position.
Figure 6B:
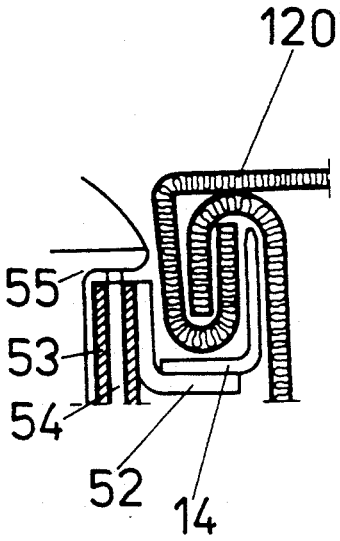
FIG. 6*a* is a side view of cartons to be lifted by the lift truck of FIG. 6.

The lift truck 1 includes two channel members 3 and 4 of which a side view is illustrated in FIG. 6. An elevator portion 72, exhibiting hook-shaped ends, is in each case attached to the channel members 3 and 4 of the lift truck 1. Grip blocks 65 and 57 exhibit hook-shaped ends and are secured to the mating hook-shaped ends of the elevator portion 72 by said hook-shaped ends. The grip blocks 65 and 57 are attached to horizontal members or cross bars 34 and 39. The cross bars 34 and 39 are permanently attached to the main frame tubes 11 and 13 of the main frame 110 by means of shims 35 and 38. The sliding tubes 66 of the lower slider assembly 111 are engaged with the main frame tubes 11 of the main frame assembly 110. The roller 29 rests in this case on the same surface as the lift truck wheels. Two restraints to the reciprocal motion of the lower slide assembly 111 exist, i.e. first, the limit of the length of the long bolt 5 and, second, the surface on which the lift truck wheels rest. If the lower slide assembly 111 is lowered with its roller 29 resting on the floor 100, then a continued raising of the elevator portion 72 will allow the lower slide assembly 111 to remain in contact with the floor 100 until a point is reached where the top piece 82 of the sliding tube 66 engages the cushion layer 84. At that point, the lower slide assembly 111 including its roller 29 will retract from the floor. A continued upward motion of the elevator portion 72 will cause the main frame assembly 110 and the lower slide assembly 111 to move upward in unison because they are at the limit of their reciprocal travel. In addition, a lowering of the elevator portion 72 will cause the roller 29 to make contact with the floor thus causing the sliding tubes 66 of the lower slide assembly 111 to slide reciprocally into the main frame tubes 11 and 13 of the main frame assembly 110 until the full limit of reciprocal travel between them is reached. In FIG. 4, the lower slide assembly 111 is at its upward limit of reciprocal travel into the main frame assembly 110.

In FIG. 6, the lifting blade 14 is attached via the bracket 55 to the channel 10 of the main frame assembly 110.

Figure 6A:
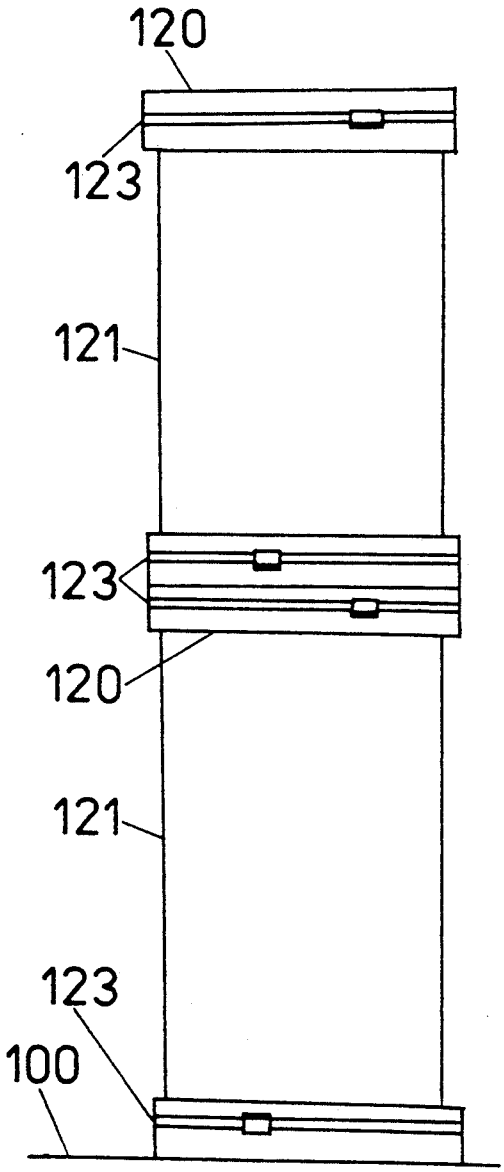

The operation of the invention manifests itself when considering the material handling of major household appliances such as refrigerators, washers, and dryers, etc. These appliances are customarily placed into corrugated cartons. As illustrated in FIG. 6*a*, the top and the bottom edges of such cartons exhibit in each case a cap 120, interlocked with the side walls 121 of the carton. A metal band 123 is in each case placed around the top and the bottom edges of the carton. An operator will move the lift truck into a position such that one lifting blade 14, in case of one carton, or two lifting blades 14, in the case of more than one carton, rests or rest against the carton side wall 121 with its top edge just below the lowest portion of top cap 120. Continued raising of the elevator portion 72 will cause the lifting blade 14 to slide in between the top cap 120 and the side wall 121 for an engagement of about 4 inches. At that point in time, the lifting blade 14 is fully engaged underneath the top cap 120, i.e. between the side wall 121 and the inner lip of the top cap 120. A continued lifting of the elevator portion 72 will cause the carton to be raised from the floor 100 and the carton can be be moved throughout the warehouse. It is an advantageous embodiment of the invention that two cartons or three cartons may be lifted at one time and placed upon two or three similar cartons whereas, if the three bottom cartons were now lifted, a lift of six cartons at one time would be achieved. It is a further advantageous embodiment of the invention that in case the sidewalls of the cartons, resting on the floor, are not perfectly coplanar, the lifting blades 14, which are coplanar in a rest position, will rotate about the pin 54 in order to meet the non-coplanar condition of the cartons, thereby enabling a perfect lift. Once the cartons are lifted, there occurs a self-straightening effect whereby the lifting blades 14 settle into the V-grooved bracket 55 thereby rendering all the cartons coplanar when lifted.

In case the cartons are not standing perfectly upright or vertical, i.e. the cartons are standing slanted on an uneven floor, the lifting blade 14 with its tapered clearance 61 will allow the lifting blade 14 to swivel similar to a windshield wiper blade in order to conform to a slanted or unlevel top cap 120, thereby eliminating high stress points at corners 2 on lifting blades 14.

When the invention attachment is employed to lift cartons in the above-described manner, the invention attachment is designed such that, when cartons are lifted, the lower slide assembly 111 drops below the bottom edge of the carton thereby assuring that the lateral reaction force is at all times applied by the lower slide assembly 111 to the bottom edge of the carton where the carton is the strongest. A proper vertical placement of the lifting blade 14 into keyholes 47 will always assure that the lower slide assembly 111 will at all times be lowered below the bottom edge of the carton regardless of the height of the carton. It is advantageous to lower the lower slide assembly 111 somewhat below the bottom edge of the carton in order to achieve a uniform stacking of the cartons with the aid of the lower slide assembly 111 gauging from the already stacked lower cartons when approaching the stack.

Figures 7, 7A, 7B, 7C:
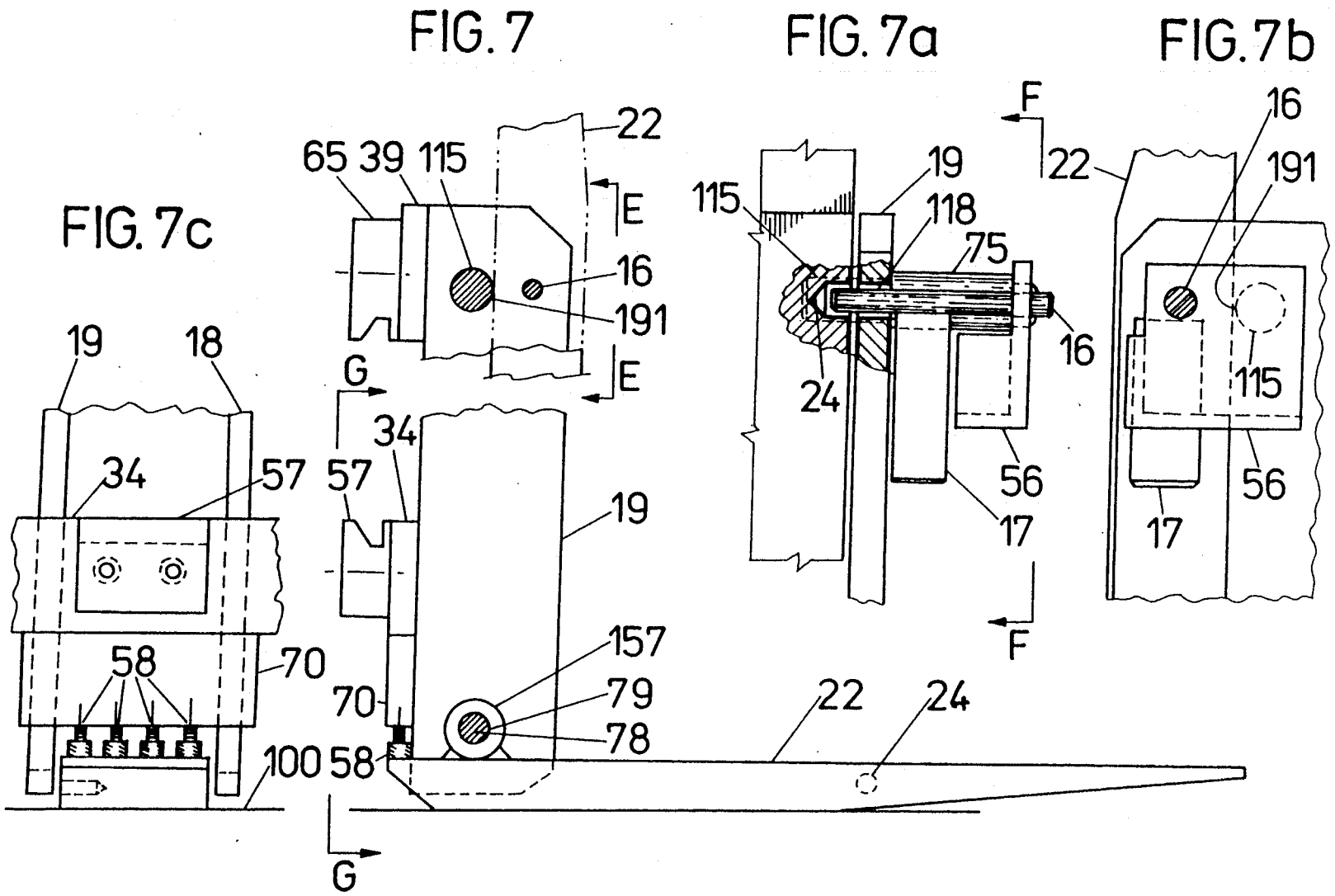
FIG. 7 is a side view of the folding fork and its side support plates, with the folding fork in a lowered position.
FIG. 7*a* is a partial cross-sectional view through the side support plate of the folding fork along section line E—E of FIG. 7.
FIG. 7*b* is a side view of the side support plate along the line F—F of FIG. 7*a*.
FIG. 7*c* is a side view of the support plate of the folding fork along the line G—G of FIG. 7.

FIG. 7 is a side view of the lower end of the main frame assembly 110. This view shows a folding fork 22 in its lowered or working position when the folding forks 22 are used and the lifting blades 14 are not used. The folding fork 22 hinges about the pin 78 in the hole 79 through the bushing 157 and the plate 19. The plates 18, 20 and 21 cannot be seen in this sectional view of FIG. 7. An adjustment to maintain the tips of the folding forks 22 at the same height level is achieved by turning the micrometer adjustment screws 58 in or out of the plate 70. FIG. 7 further illustrates a portion of the folding fork 22 in their uppermost alternate position resting against the stop 115 at the tangent point 191. In this case, the forks 22 and 23 protrude forward of the side plate 19 by about ¼ inch and form a plane (B). This achieves a minimization of the effect of the lateral reaction force exerted by the lower end of the lifted carton and prevents a hampering of the automatic lowering of the lower slide assembly 111. The pin 115 at the tangent point 191 provides a stop for the fork 22 in its uppermost position, wherein the pin 16 is aligned in said position such that it will index with the hole 24 in the folding fork 22. When the pin 16 is in the hole 24 of the folding fork 22, the folding fork is fixedly maintained in the uppermost position.

FIG. 7*a* shows a pin 16 permanently joined to the weighted lever 17 and inserted through the hole 118 provided in the fork side plate 18 and engages the hole 24 in the folding fork 22 when the folding fork is in its upright position. The folding fork shown in the uppermost position can only be released by withdrawing the pin 16 from the hole 24 in the folding fork 22. As shown in FIG. 7*a*, the pin 16 cannot be withdrawn because the bracket 56 is in the path of weighted lever 17. A release of the pin 16 is achieved by swinging the weighted lever upward out of the vertical plane through an arc of 180°. When at its top position, the weighted lever 17 may then be moved past the bracket 56 thereby withdrawing the pin 16 from the hole 24 in the folding fork 22. The arrangement of the gravity-biased lever 17 provides a safe, sturdy, and reliable locking mechanism for keeping folding forks of this nature in an extremely secure position. A release of the pin 16 can only be achieved if the weighted lever 17 opposes gravity by moving the weighted lever 17 upward by 180° and then withdrawing the pin 16 laterally from the hole 24 of the folding fork 22. When the folding forks 22 and 23 are to be used, it is necessary for the lower slide assembly 111 to be locked in the uppermost position in main frame assembly 110. A locking of the lower slide assembly 111 in its uppermost position in the main frame assembly 110 is achieved by inserting the channel 184 with the pin 185 into holes 87 and 88 illustrated in FIG. 4 and FIG. 4*a*.

Figure 8:
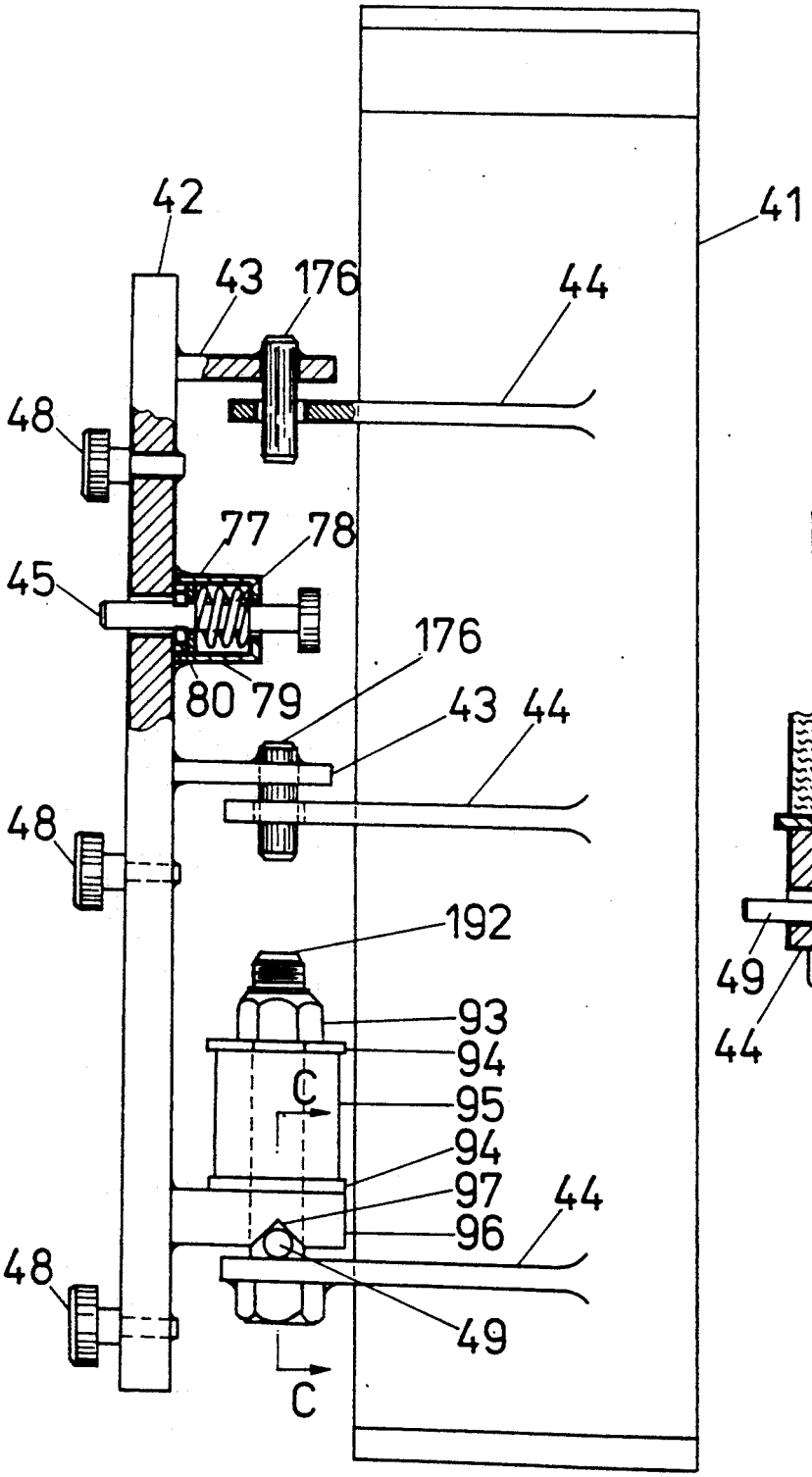
FIG. 8 is an elevational and in part sectional view of side attachment breakaway wings affixed to respective attachments.
Figure 8A:
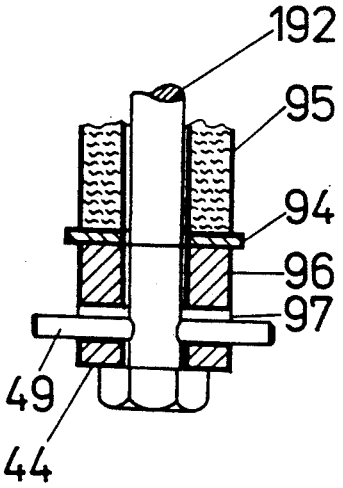
FIG. 8*a* is a cross-sectional view through a lower hinge assembly along section line C—C of FIG. 8.

FIG. 8 illustrates in detail the extension plates or breakaway wings or side attachments 40, 41 illustrated in FIGS. 1*a* and 1*b*. The side attachment plate 41 is hingedly disposed about the hinge pins 176, the bolt 192, and the bar 42. The bar 42 engages the pierced angle 36 of FIGS. 1, 3 and 6. The projections or pin heads 48 engage the keyholes 67, 68, and 69, and are maintained in a fixed position on the pierced angle 36 by means of the spring biased pin 45 in the indexing hole 46 in the pierced angle 36. This hinged arrangement is advantageous because the hinged side attachments 40, 41 overhang and protrude beyond the width of the lift truck 1. An overhanging or a protrusion of the side attachments 40, 41 could result in collisions and destroy the side attachments 40, 41 and thereby could also damage the lower slide assembly if the hinged side attachments were rigidly mounted. The invention structure of the hinged side attachments or breakaway wings 40 and 41 permits the side attachments 40 and 41 to perform their normal function of staying coplanar with pusher plates 25, 26, 27, and 28, illustrated in FIG. 3. This is achieved by the pin 49 resting in the V-shaped groove 97 and biased by the highly elastic polyurethane bushing 95. An adjustment of the lock nut 93 can compress the polyurethane bushing 95 so as to impart enough rigidity to the side attachments 41 to perform its normal function of supporting wide loads at the outermost cartons. If a collision occurs, usually without carrying product, the side attachment 41 will tilt by 90° either frontward or rearward depending on the direction of the impact. During a tilting of the side attachment 41 caused by a collision, the pin 49 jumps out crosswise from the V-shaped groove 97 against the biasing of the elastic polyurethane bushing 95. After such a dislodging of the pin 49, resulting from an impact to the side attachment 41, the side attachment 41 needs only to be pushed into its coplanar position in order to allow the pin 49 to snap back into the V-shaped groove 97. The side attachment 41 is now ready for service again without costly downtime.

It is furthermore advantageous that the lower hinge assembly as well as the upper hinges of the invention structure are designed such that when the side attachment 41 is struck, it will not only rotate about the hinge plate 96 but the hinged parts 44 will also migrate downward as it rotates because the pin 49 is riding downward out of the V-shaped groove 97.

In an alternate embodiment, this hinge arrangement can be achieved by disposing the hinged parts 44 above the hinge plate 96. This would result in forcing the hinged parts 44 to move upward against the force resulting from the acceleration of gravity plus the force supplied by the stored energy of the elastomer bushing 95.

In a preferred embodiment illustrated in FIG. 8, the rotation of the hinged parts 44 migrates downward. This results in a smoother "breakaway" motion since the resistance to rotation is now the difference of the spring force and gravity, as compared to the sum of the two. This "breakaway" or side attachment arrangement saves enormous repair costs and production downtime.

Figures 9, 9A, 9B:
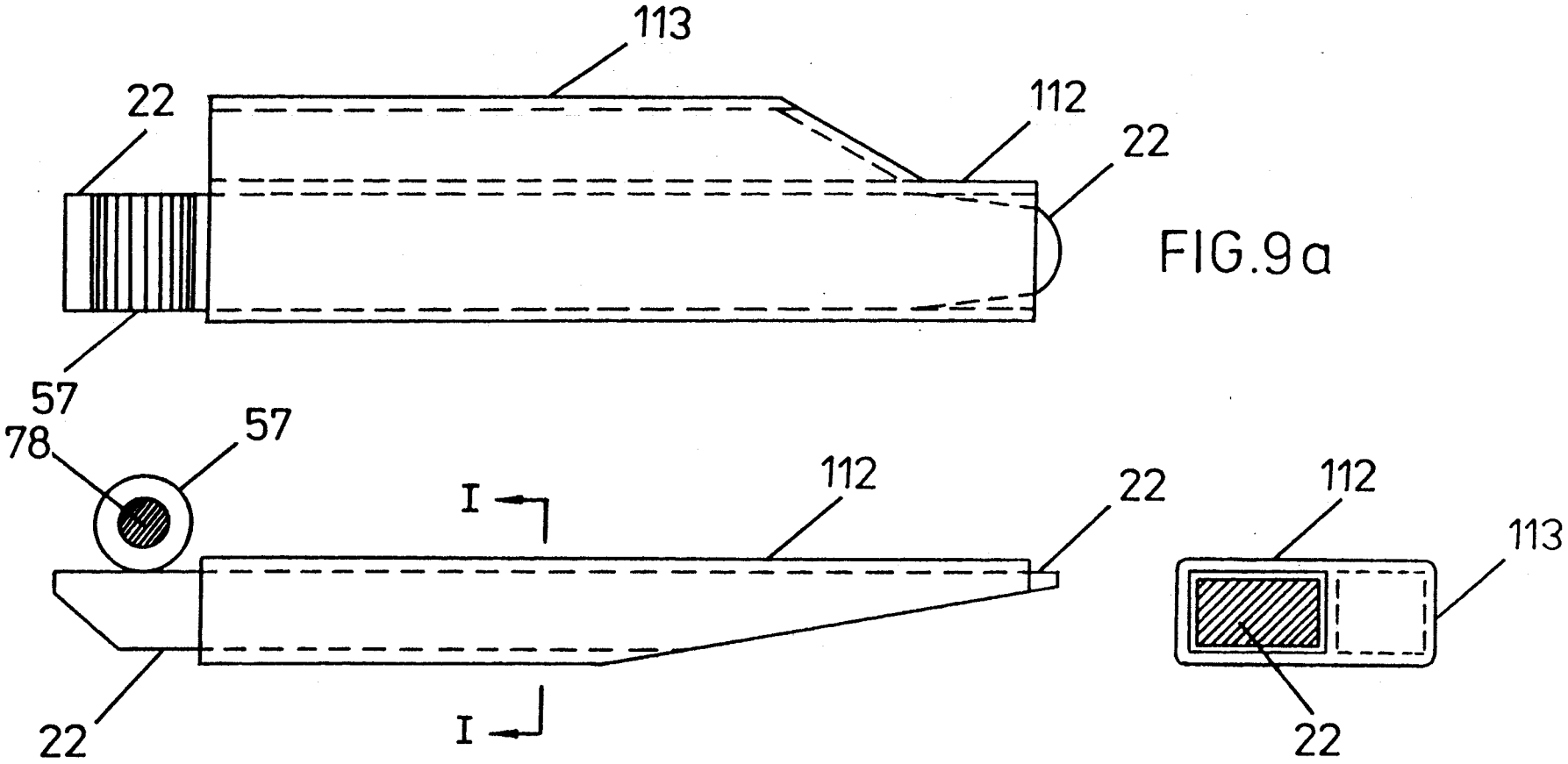
FIG. 9 illustrates a top view of tubular box fitting over the folding forks.
FIG. 9*a* illustrates a top view of tubular box fitting over the folding forks.
FIG. 9*b* is a cross-sectional view through the tubular box along section line I—I of FIG. 9.

The forks 22 and 23 illustrated in FIG. 1 have a lateral centerline distance which is fixed. If the overall width of the forks 22 and 23 is to be increased in order to allow a picking up of wider loads, a tubular box 112 can be slipped onto each fork 22 and 23, as illustrated in FIG. 9. FIG. 9*a* illustrates a top view of the embodiment of FIG. 9. By virtue of the off-center portion 113 being disposed toward the outer side of the forks, the overall width of the forks is increased, as illustrated in FIG. 9b. The spacing between the forks 22 and 23 can be decreased in that the tubular box 112 is disposed with its off-center portion 113 facing inwardly, thereby allowing extra support for narrower loads. The tubular box 112 can be formed of carbon steel.

It will be understood that each of the elements described above, or two or more together, may also find a useful application in other types of attachment assemblies differing from the types described above.

While the invention has been illustrated and described in the context of a lift truck attachment, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appendec claims:

1. A lift truck attachment for handling loads comprising a main frame assembly for attachment to an elevator of a lift truck including a first channel member disposed in an upright position;

a second channel member disposed substantially parallel to the first channel member;

a first main frame vertical tube associated with the first channel member;

a second main frame vertical tube associated with the second channel member;

a first upper closing member with a first center bore attached to an upper end of the first main frame vertical tube;

a second upper closing member with a second center bore attached to an upper end of the second main frame vertical tube; and a lower slide assembly including a first lower sliding tube slidingly disposed in the first main frame vertical tube;

a second lower sliding tube slidingly disposed in the second main frame vertical tube;

a third upper closing member with a third center bore attached to an upper end of the first lower sliding tube;

a fourth upper closing member with a fourth center bore attached to an upper end of the second lower sliding tube;

a first bolt having attached a first end member at an upper end and having attached a third end member at a lower end and passing through the first center bore and passing through the third center bore such that the first closing member and the third closing member are disposed between the first end member and the third end member;

a second bolt having attached a second end member at an upper end and having attached a fourth end member at a lower end and passing through the second center bore and passing through the fourth center bore such that the second closing member and the fourth closing member are disposed between the second end member and the fourth end member.

2. The lift truck attachment according to claim 1 further comprising a first flange plate having upwardly extending holes with a larger size in an upper region of said upwardly extending holes of said first flange plate;

a first bar having pins with pin heads disposed on a first side of the first bar and matching the holes of the first flange plate;

first hinged parts extending horizontally on a second side of the first bar disposed opposite to the first side of the first bar;

a first breakaway wing attached to the first hinged parts;

a second flange plate having upwardly extending holes with a larger size in an upper region of said upwardly extending holes of said second flange plate;

a second bar having pins with pin heads disposed on a first side of the first bar and matching the holes of the second flange plate;

second hinged parts extending horizontally on a second side of the second bar disposed opposite to the first side of the second bar; and a second breakaway wing attached to the second hinged parts.

3. The lift truck attachment according to claim 2 further comprising a first horizontally disposed pin attached to one of the first hinged parts;

a first projection arm of the first breakaway wing having a horizontal groove engaging the first horizontal pin from above for forming a disengageable connection between the first bar and the first breakaway wing;

a second horizontally disposed pin attached to one of the second hinged parts;

a second projection arm of the second breakaway wing having a horizontal groove engaging the second horizontal pin from above for forming a disengageable connection between the second bar and the second breakaway wing.

4. The lift truck attachment according to claim 1 further comprising a first upright pin attached to the first main frame vertical tube;

a first V-shaped block having a first upright borehole with a larger upper diameter, wherein the first upright pin is disposed in the first upright bore hole allowing the block to shift in a plane parallel to a plane spanned by the first main frame vertical tube and the second main frame vertical tube;

a first lifting blade attached to the first upright block;

a second upright pin attached to the second main frame vertical tube;

a second V-shaped block having a second upright borehole with a larger upper diameter, wherein the second upright pin is disposed in the second upright bore hole allowing the block to shift in a plane parallel to a plane spanned by the first main frame vertical tube and the second main frame vertical tube;

a second lifting blade attached to the second upright block.

5. The lift truck attachment according to claim 1 further comprising a first fork attached to a first side plate set of the main frame assembly;

a first pin hole disposed substantially horizontally in the first fork;

a first fork locking pin hingedly supported;

a first weight attached to the first fork locking pin for retaining the first fork locking pin in a locked position while engaging the first fork;

a second fork attached to a second side plate set of the main frame assembly;

a second pin hole disposed substantially horizontally in the second fork;

a second fork locking pin hingedly supported;

a second weight attached to the second fork locking pin for retaining the second fork locking pin in a locked position while engaging the second fork.

6. The lift truck attachment according to claim 1 further comprising a first fork attached to a first side plate set of the main frame assembly;

a first stop face furnished at a first heel of the first fork;

first adjustment means engaging the first stop face for adjusting a position of the first fork when lowered;

a second fork attached to a second side plate set of the main frame assembly;

a second stop face furnished at a second heel of the second fork;

second adjustment means engaging the second stop face for adjusting a position of the second fork when lowered.

7. The lift truck attachment according to claim 1 further comprising a first plastic guide attached to the upper end of the first lower sliding tube for defining a lateral position of the first lower sliding tube in the first main frame vertical tube;

a second plastic guide attached to the upper end of the second lower sliding tube for defining a lateral position of the second lower sliding tube in the second main frame vertical tube.

8. The lift truck attachment according to claim 1 further comprising a first cushion disposed between the first closing member and the first end member;

a second cushion disposed between the second closing member and the second end member.

9. The lift truck attachment according to claim 1 further comprising a third cushion disposed between the third closing member and the first end member;

a fourth cushion disposed between the fourth closing member and the second end member.

10. The lift truck attachment according to claim 1 further comprising a first tube locking pin for locking the first main frame vertical tube to the first sliding tube;

a second tube locking pin for locking the second main frame vertical tube to the second sliding tube for immobilizing the lower slide assembly relative to the main frame.

11. The lift truck attachment according to claim 1 further comprising a first fork attached to a first side plate set of the main frame assembly;

a second fork attached to a second side plate set of the main frame assembly;

a first fork plate disposed upright neighboring the first fork on a side remote relative to the second fork and set back by at least 0.5 centimeters relative to an upright rest position of the first fork and of the second fork.

12. The lift truck attachment according to claim 1 further comprising a first fork attached to a first side plate set of the main frame assembly;

a second fork attached to a second side plate set of the main frame assembly;

a fork plate disposed upright neighboring the second fork on a side remote relative to the first fork and set back by at least 0.5 centimeters relative to an upright rest position of the first fork and of the second fork.

13. The lift truck attachment according to claim 1 further comprising a first fork attached to a first side plate set of the main frame assembly;

a second fork attached to a second side plate set of the main frame assembly;

a fork plate disposed upright between the first fork and the second fork and set back by at least 0.5 centimeters relative to an upright rest position of the first fork and of the second fork.

14. The lift truck attachment according to claim 13 further comprising a second fork plate disposed upright between the first fork and the second fork and set back by at least 0.5 centimeters relative to an upright rest position of the first fork and of the second fork.

* * * * *